US006739173B2

(12) United States Patent
Lowery

(10) Patent No.: US 6,739,173 B2
(45) Date of Patent: May 25, 2004

(54) SHEET METAL FORMING TOOL

(76) Inventor: Robert S. Lowery, 8247 Forest Lake Dr., Conway, SC (US) 29526

( * ) Notice: Subject to any disclaimer, the term of this patent is extended or adjusted under 35 U.S.C. 154(b) by 0 days.

(21) Appl. No.: 10/225,742

(22) Filed: Aug. 22, 2002

(65) Prior Publication Data

US 2003/0037587 A1 Feb. 27, 2003

Related U.S. Application Data

(60) Provisional application No. 60/314,452, filed on Aug. 23, 2001.

(51) Int. Cl.[7] ..... B21D 1/12
(52) U.S. Cl. ..... 72/466.8; 72/705
(58) Field of Search ..... 72/466.6, 466.8, 72/705; 81/DIG. 12

(56) References Cited

U.S. PATENT DOCUMENTS 2,464,118 A * 3/1949 Countryman ..... 72/705
2,483,626 A * 10/1949 Daku ..... 72/705
6,029,486 A * 2/2000 Haraga et al. ..... 72/466.8

* cited by examiner

*Primary Examiner*—Lowell A. Larson
(74) *Attorney, Agent, or Firm*—Womble Carlyle Sandridge & Rice PLLC

(57) ABSTRACT

A sheet metal forming tool is designed to remove raised eyebrows surrounding dents in the body of a vehicle before the dent itself is pulled back to a flush configuration. The tool comprises a pneumatic hammer driver provided with a special attachment having a body and a plastic head. The head is formed of plastic and is configured to define a ring-shaped support base that surrounds a dome-shaped hammer pad. A hammer within the tool impacts the back of the hammer pad at a frequency of between 2000 and 5000 impacts per minute, each impact moving the hammer pad slightly outwardly with respect to the plane of the support base. In use, the head is placed over an eyebrow to be treated with the support base resting on the surface surrounding the eyebrow and the hammer pad overlying the eyebrow. The tool is then actuated and moved along the eyebrow until it is bent back down flush with the surrounding surface.

11 Claims, 3 Drawing Sheets

SHEET METAL FORMING TOOL

RELATED APPLICATIONS

The benefit of the filing date of U.S. Provisional Patent Application, Serial No. 60/314,452 filed on Aug. 23, 2001 is hereby claimed under 35 USC Section 119(e).

TECHNICAL FIELD

This invention relates generally to sheet metal forming and more particularly to repairing dents and dings in body panels of vehicles.

BACKGROUND

Historically, dents in the sheet metal body panels of vehicles have been repaired by various manual pulling, filling, and repainting techniques. Unfortunately, these old techniques are time consuming, expensive, require substantial skill and experience, and often produce less than desirable results. More recently, dent repair tools and techniques have been developed that eliminate many of these problems. In general, these new techniques involve adhering a small specially shaped plastic puller to the central portion of a dent with a high strength adhesive and applying a pulling force to the puller, preferably with a pneumatic or hydraulic pulling tool, to pull the dent back to a flush configuration.

Inevitably, an impacting object that causes a depression or dent in the sheet metal of a vehicle body also, at the time of impact, causes the sheet metal to raise a small amount around a portion of the indented area. This impact forms an arched raised lip or rim around part of the dent, which is known in the industry as an "eyebrow." Prior to pulling a dent out of a body panel, a dent removal technician first must treat the surrounding eyebrow by carefully hammering it down until it is flush with the surrounding sheet metal. Otherwise, the eyebrow will remain visible as a small arched raised bump where the repair was made.

Currently, techniques for treating eyebrows are difficult to learn and require substantial skill and experience to master. These techniques involve the use of a hard plastic punch-like device that is placed over the eyebrow and carefully tapped repeatedly with a sheet metal hammer until the eyebrow is hammered back to a flush configuration. In many instances, and particularly when a technician is not experienced or is in a hurry, this technique can result in the raised sheet metal of the eyebrow being over or under stretched and, more often than not, causes tiny dents, kinks, or other collateral damage that cannot be repaired without sanding and repainting the entire area of the original dent.

Accordingly, a need exists for a methodology and a tool for treating eyebrows when repairing dents in vehicles that tends to be more reliable, accurate, and as fast as existing methods and tools; that reduces the risk of over stretching the metal beyond a flush configuration; that reduces the risk of collateral damage to the indented area; and that does not require a high level of skill and experience of a dent removal technician. More broadly, a need exists for a sheet metal forming tool and technique for removing small raised areas in the sheet metal. It is to the provision of such a tool and methodology that the present invention is primarily directed.

SUMMARY OF THE INVENTION

Briefly described, the present invention encompasses a sheet metal forming tool specifically designed to treat a raised eyebrow surrounding a dent in a body panel of a vehicle before the dent is pulled out. More specifically, the tool is designed to remove an eyebrow by progressively hammering it back down to a configuration flush with the surrounding surface while avoiding the risk of over depressing the eyebrow beyond flush or causing collateral damage to the sheet metal. The tool comprises a hammer driver operably connected to a metal forming attachment for treating an eyebrow. The hammer driver may be a hand-held pneumatic type driver. The attachment comprises a hammer, a base, and a hammer pad aligned to engage the hammer when the hammer is actuated. The hammer is contained within a housing coupled to the hammer driver and extending to a distal end. A head defining the base and the hammer pad is mounted to the distal end of the housing. The head, hammer pad and base may be formed of a suitable polymeric material, such as polyurethane or machined rubber that tends to be both substantially rigid and non-marring. The head is molded, machined, or otherwise formed to define a generally flat ring-shaped support base, which surrounds the convex or dome-shaped structure referred to herein as the hammer pad. The inside surface of the hammer pad within the housing may be formed with a concave shape. Thus, when viewed in cross-section, the hammer pad portion of the plastic base resembles a section of a sphere.

An elongated hammer is reciprocally and axially mounted within the housing and has a proximal end coupled to the piston of the hammer driver and a distal end located adjacent the inside surface of the hammer pad. The distal end of the hammer is formed with a convex or dome shape that is sized to complement and to nest within the concave inside surface of the hammer pad when the hammer is driven into engagement with the pad. When the hammer is driven toward the inside surface of the hammer pad by the hammer driver, its convex distal end impacts and nestles or nests within the concave inside surface of the hammer pad. This impact, in turn, causes the plastic material of the head to stretch slightly such that the hammer pad moves or flexes slightly outwardly with respect to the plane of the surrounding support base. After the impact, the hammer pad returns to its rest position with respect to the support base. In use, the hammer is repeatedly driven against the inside surface of the hammer pad by the pneumatic hammer with a frequency, for example, in the range of between 2000 and 5000 impacts per minute.

The present invention also encompasses a method for forming sheet metal that generally comprises placing a metal sheet forming tool as described above over the section of the sheet metal containing an a raised portion such that the hammer pad of the tool defined in the head overlies the raised portion and the base of the tool rests upon the surface of the sheet metal adjacent the raised portion. The hammer of the tool is activated to engage the hammer pad, thereby causing the pad to reciprocally flex outward. The head of the tool may be moved back and forth along the raised portion to smooth out the defect.

More specifically, when using the tool to carry out the method of the invention, a dent repair technician places the head of the tool over an eyebrow to be treated with the support base resting on the undamaged surface of the sheet metal surrounding the eyebrow and with the dome-shaped hammer pad overlying the eyebrow. The pneumatic hammer is then actuated to drive the internal hammer repeatedly against the inside surface of the hammer pad. With each impact, the hammer pad moves outwardly a slight distance with respect to the plane of the surrounding support base. The air pressure to the hammer may be adjusted such that the center portion of the hammer pad moves outwardly to a position substantially in the plane of the support base. Since the support base rests on the undamaged sheet metal surface adjacent the damaged area, the plane of the support base lies in and is co-extensive with the original plane of the surface prior to being damaged. Therefore, because the eyebrow is raised relative to this original plane, the outwardly flexing hammer pad impacts the eyebrow with substantial force, causing the metal in the region of the eyebrow to be bent back toward a flush configuration.

Repeated impacts by the hammer pad at the aformentioned frequency of between 2000 and 5000 per minute gradually and gently hammer the eyebrow down until it is again flush with the surrounding surface of the sheet metal. In practice, it has been found that slowly moving the tool around and along the eyebrow during operation gradually massages the eyebrow down to its flush configuration along its entire length without causing the kinking and other small difficult-to-repair collateral damage common with prior art manual techniques. The elimination of such collateral damage is due, at least in part, to the smoothly contoured hammer pad and the non-marring plastic construction of the head.

Further, since the center portion of the hammer pad moves outwardly to the plane of the support base, and thus to the plane of the surrounding metal surface, when a section of the eyebrow becomes flush, it is no longer impacted by the hammer pad. Thus, over depression of the eyebrow beyond a flush condition, typical with prior art techniques, tends not to occur when using the tool of the present invention. When the eyebrow surrounding a dent has been rendered completely flush, a dent puller tool may be applied to the dent to restore the damaged area to its original shape, all without the need to fill, sand, and repaint.

Thus, a tool and methodology for treating eyebrows in the repair of automotive dents is now provided that tends to be reliable, accurate, and quick; that does not require a high degree of skill or experience by a dent repair technician; and that tends not to cause collateral damage, which can be worse than the original dent itself. The design of the hammer pad and hammer insures that a treated eyebrow is gradually and gently massaged back to a flush condition and that over depression beyond flush does not occur. These and other features, objects, and advantages of the invention will become more apparent upon review of the detailed description set forth below when taken in conjunction with the accompanying drawing figures, which are briefly described as follows.

DETAILED DESCRIPTION OF THE PREFERRED EMBODIMENTS

Figure 1:
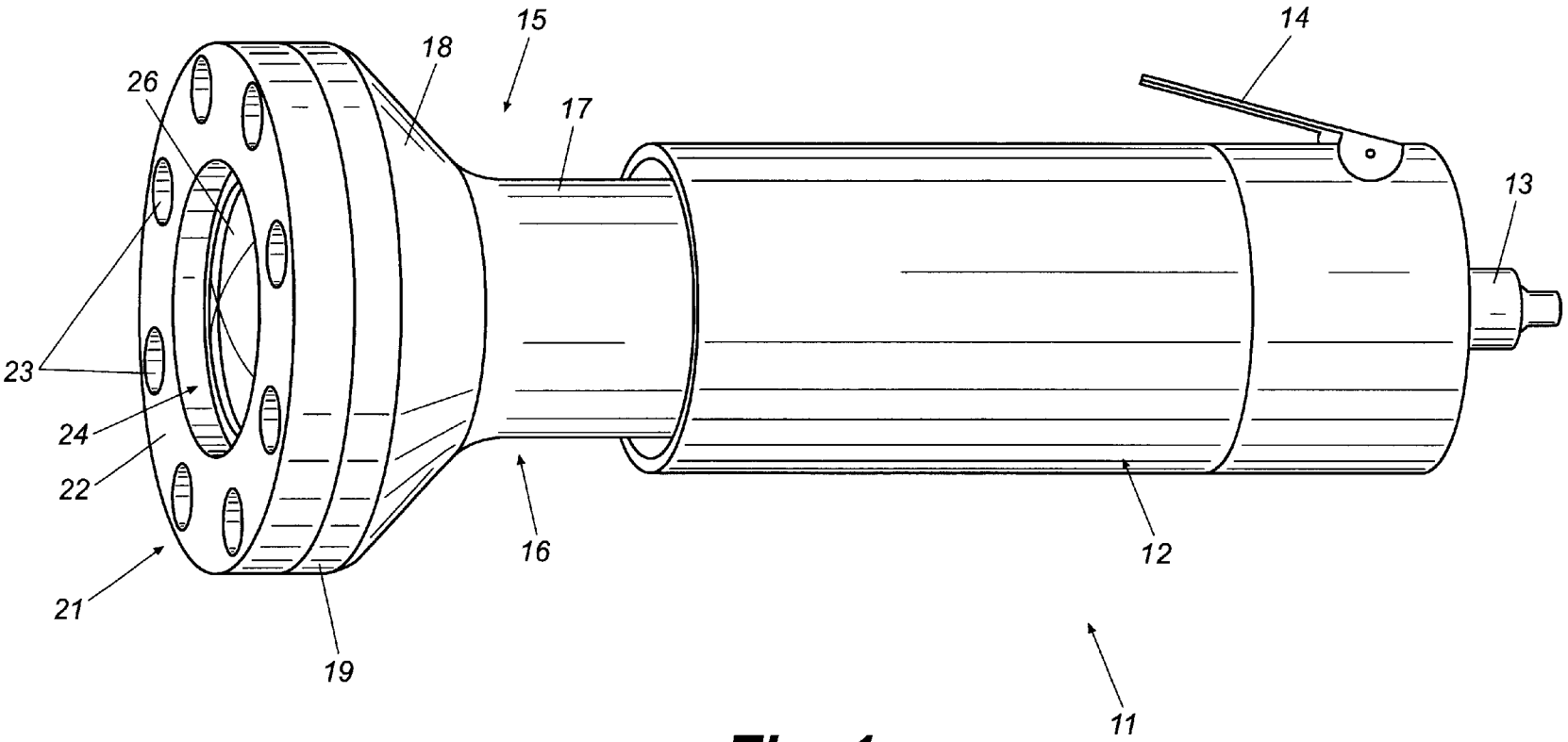
FIG. 1 is a perspective view of a pneumatic metal forming tool that embodies principles of the invention.

Referring now in more detail to the accompanying drawings, in which like numerals refer, where appropriate, to like parts throughout the several views, FIG. 1 illustrates a metal forming tool that embodies key principles of the present invention. The tool 11 comprises a standard pneumatic hammer driver 12 having a compressed air inlet port 13 and an trigger 14 for activating the driver. The hammer driver 12 itself may be a common off-the-shelf component that is available from a number of manufacturers and need not be described in detail here. Generally, however, a user holds the body of the driver in a hand for use and depresses the trigger 14 when it is desired to activate the driver.

A metal forming attachment 15 according to the invention is coupled to the hammer driver 12. The attachment 15 includes a housing 16 configured to be coupled to the hammer driver 12 in the same way as other tools. The housing 16 of the illustrated embodiment has a cylindrical portion 17 coupled to the driver, a flared portion 18, and a substantially circular distal end portion 19. Housings of different configurations are possible depending upon application specific parameters. A head 21, which may be made of a substantially rigid and non-marring plastic or polymeric material, such as, for example, polyurethane or rubber that is machined, molded, or otherwise formed to define a substantially flat ring-shaped support base 22. The material from which the head is formed should be sufficiently hard to cause the sheet metal to move when the hammer is activated, without being so hard as to mar the metal. For example, the head may be formed from a material that exhibits a hardness in the range of about 70 to about 100 durometers on the A scale. In one embodiment, the head is formed from a polyurethane material exhibiting a hardness of approximately 90 durometers on the A scale. Bolt holes 23 are formed around the support base to accommodate bolts that secure the head 21 to the distal end portion 19 of the housing.

The support base 22 of the head surrounds a generally dome-shaped hammer pad 24 having an exposed outer surface 26. The hammer pad projects outwardly such that the center portion of its outer surface has a normal or rest position just below the plane of the ring-shaped support base 22.

Figure 2:
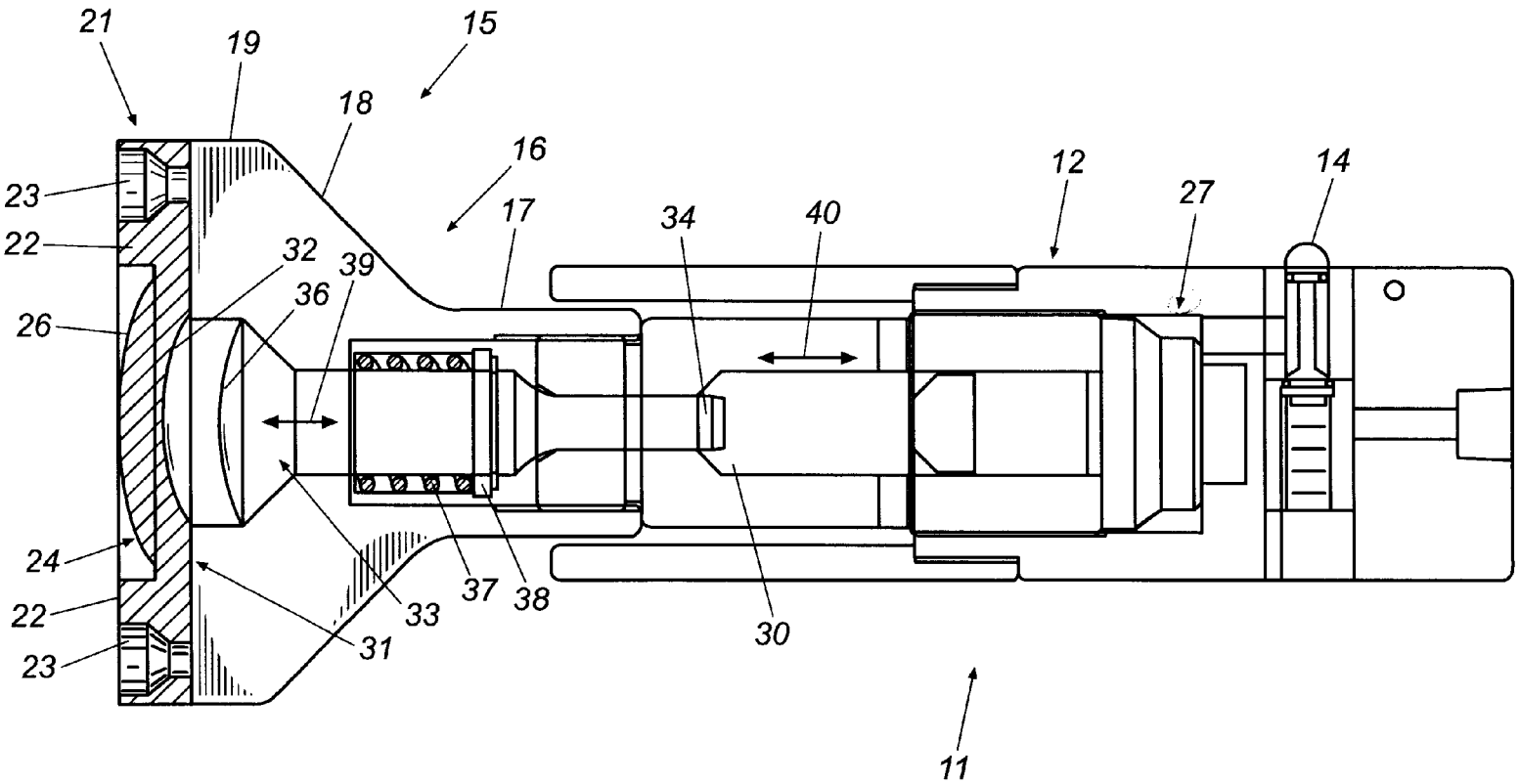
FIG. 2 is a partially cross-sectioned phantom drawing of the tool of FIG. 1 showing various internal components thereof.

FIG. 2 illustrates key internal working components of the tool of this invention. The internal components 27 of the pneumatic hammer driver 12 are those generally found in a known hammer driver. In general, however, the driver includes an internal air pressure driven piston that has a distal end portion 30. The piston reciprocates back and forth as indicated by arrow 40 at a frequency of from 2000 to 5000 cycles per minute when the trigger 14 is depressed. The attachment 15 is coupled to the end of the driver in the same way as other tool attachments and includes a body 16 having a cylindrical portion 17, a flared portion 18, and a distal end portion 19. An elongated hammer 33 is axially and reciprocally mounted within the housing 16. The hammer 33 has a proximal end portion 34 that couples to the distal end 30 of the driver piston and a distal end portion 36 located adjacent the inside surface 32 of the hammer pad 24. The distal end 36 of the hammer 33 has a convex or dome shape as shown. The inside surface 32 of the hammer pad 24 preferably is formed with a concave shape that is complementary to the convex shape of the distal end 36 of the hammer 33. That is, the radius of curvature of the distal end 36 of the hammer 33 may correspond to the radius of curvature of the concave inside surface 32 of the hammer pad. Thus, as the hammer 33 is reciprocated back and forth by the hammer driver 12 as indicated by arrows 39, its convex distal end repeatedly impacts the concave inside surface 32 of the hammer pad 24. With each impact, the distal end of the hammer 33 nests against the inside surface of the hammer pad 24 to spread the energy of the impact evenly over the surface. A coil spring 37 and retainer 38 moves the hammer 33 back to its rest position after each impact.

Each time the hammer 33 impacts the inside surface of the hammer pad 24 as described, the energy imparted to the hammer pad 24 causes the plastic material of the head to deform or stretch slightly. This, in turn, causes the hammer pad 24 to move slightly outwardly from its rest position to its extended position. The distance that the hammer pad 24 moves or flexes can be adjusted by adjusting the air pressure delivered to the tool. Because of the substantially rigid nature of the polymeric material from which the head is formed, the distance that the hammer pad moves is substantially constant from impact to impact and, following each impact, the plastic of the head rebounds to retract the hammer pad virtually instantaneously back to its rest position. Thus, operation of the tool causes the hammer pad to oscillate along the axis of the attachment at the frequency of operation of the hammer driver.

Figure 3:
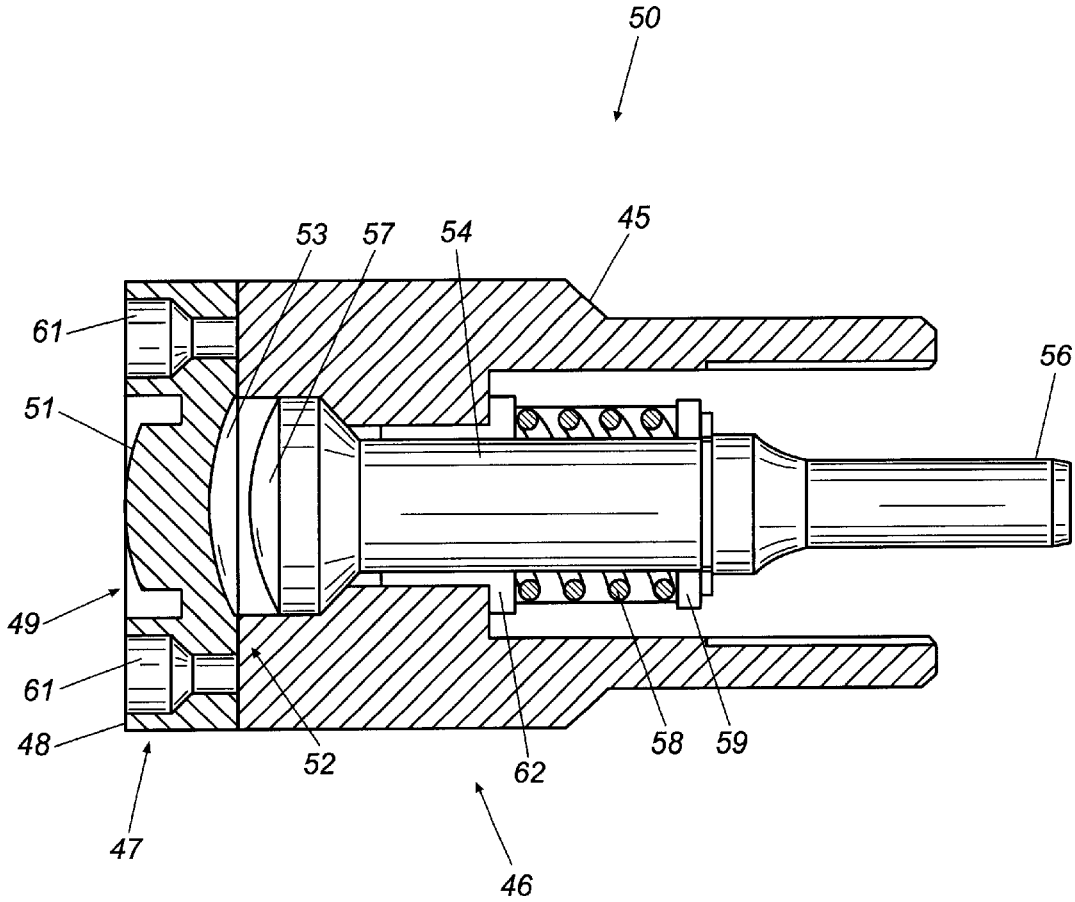
FIG. 3 is a cross-sectional view of an alternate embodiment of the attachment including a different configuration of the housing and head.

FIG. 3 illustrates an alternate embodiment of the present invention for use in treating smaller eyebrows or other smaller raised areas in sheet metal. The function and operation of this embodiment is substantially the same as that of the previously discussed embodiment, but the configuration is a bit different. Here, the attachment 50 has a body 46 with a much smaller flared portion 45 such that the diameter of the distal end of the body is smaller than that of FIG. 1. A polymeric head 47 is mounted to the distal end of the body with bolts or other appropriate fasteners and is molded or machined to define a substantially flat ring-shaped support base 48. The support base 48 surrounds a central hammer pad 49 of the head that, again, is generally convex or dome shaped, but that is smaller in transverse diameter that the hammer pad of FIG. 1. The hammer pad 49 thus forms a dome-shaped outer surface 51 that is suitable for treating smaller eyebrows and other bumps in a sheet metal surface. As with FIG. 1, an elongated hammer 54 is axially and reciprocally disposed in the body 46 and has a proximal end 56 formating with the piston of a pneumatic hammer driver and a distal end 57, which is formed with a convex shape. The inside surface 53 of the hammer pad is concave and complementary to the distal end 57 of the hammer so that the distal end of the hammer nests within the inside surface 53 of the hammer pad on each impact. As with the previous embodiment, an impact of the hammer with the inside surface of the hammer pad during operation of the tool causes the hammer pad to move slightly outwardly from its rest position to an extended position wherein the center of its outer surface 51 is substantially in the plane of the ring-shaped support base. Reciprocal motion of the hammer causes corresponding reciprocal movement of the hammer pad and, for use in removing eyebrows in dent repair, operation in the range of 2000 to 5000 impacts per minute have been found desirable.

The tool of this invention is used to carry out the method of the invention for treating eyebrows around dents in a vehicle body before pulling out the dents. Specifically, a technician first inspects the dent and its surrounding eyebrow and, based upon its size and shape, selects the appropriately sized attachment for the job and secures it to the hammer driver. The pressure to the driver is then set, preferably initially to a low value that can be increased if needed, and the head of the tool is positioned over the eyebrow with its ring-shaped support base surrounding the eyebrow. The trigger of the tool is activated and the head is moved slowly back and forth along the eyebrow. The ring-shaped support base rides on the undamaged surface of the sheet metal surrounding the dent and eyebrow and thus insures that the hammer pad does not move beyond the plane of the surface. In this way, the support base prevents the hammer pad from extending beyond the plane of the surrounding sheet metal surface and thus prevents over depression of the eyebrow beyond a flush condition.

As the tool is moved slowly along the eyebrow, the hammer pad of the head repeatedly but gently impacts the eyebrow and each blow drives the eyebrow down slightly toward a position flush with the surrounding surface. The technician may remove the tool periodically to check the progress of the repair and, when the eyebrow is completely removed, the eyebrow repair process is complete. The technician may then use a dent puller tool to pull the adjacent dent back to a flush configuration, whereupon the repair is complete. Not only is the dent removed, but the surrounding eyebrow also is completely eliminated, resulting in a near perfect dent repair, all using a tool and process that causes no collateral damage and that does not require a high level of skill or experience on the part of the technician.

The invention has been described herein in terms of certain embodiments and methodologies that represent the best mode known to the inventor of carrying out the invention. It will be understood by those of skill in the art, however, that various additions, deletions, and modifications to the illustrated preferred embodiments might well be made, all without departing from the spirit and scope of the invention disclosed herein. For instance, the shape of the distal end of the hammer and the inside surface of the hammer pad might be other than convex and concave for particular applications. Further, heads with elongated or oval hammer pads might be designed to deal with dents and eyebrows of particular configurations. Finally, while the disclosed embodiments have been discussed in terms of removing dents from body panels of vehicles, the tool also is useful in any circumstance where the surface of sheet metal needs to be formed or worked in a similar way. Thus, the invention should be thought of broadly as a sheet metal forming tool rather than just a dent repair tool.

What is claimed is:

1. A sheet metal forming tool comprising:

a hammer driver; and, a metal forming attachment operably connected to said hammer driver, wherein metal forming attachment comprises a hammer, a base and a hammer pad aligned to engage said hammer when said hammer is actuated, wherein said hammer pad is formed with a concave surface proximally aligned with said hammer.

2. A sheet metal forming tool comprising:

a hammer driver; and a metal forming attachment operably connected to said hammer driver, wherein said metal forming attachment comprises a hammer, a base and a hammer pad aligned to engage said hammer when said hammer driver is actuated, wherein said hammer pad flexes outwardly when engaged by said hammer.

3. The metal forming attachment of claim 2, wherein said hammer pad is formed of a polymeric material.

4. The metal forming attachment of claim 3, wherein said polymeric material is polyurethane.

5. The metal forming attachment of claim 2, wherein said hammer pad is formed with a convex outer surface.

6. The metal forming attachment of claim 2, wherein said hammer pad is formed with a concave inner surface.

7. A sheet metal forming tool for driving a raised section of the sheet metal to a position flush with the surrounding surface of the sheet metal, said tool comprising:

a base having a head formed with a peripheral portion configured to rest on the surface of the sheet metal surrounding the raised section and a central portion for positioning over the raised section;

said central portion of said head forming a hammer pad having an exposed outer surface recessed from a plane of said peripheral portion and an inside surface;

a hammer aligned with said hammer pad and having a distal end normally disposed adjacent said inside surface of said hammer pad; and, a hammer driver coupled to said base and said hammer for reciprocally driving said distal end of said hammer against said inside surface of said hammer pad to flex said exposed outer surface of said hammer pad outwardly to a position substantially co-extensive with the plane of said peripheral portion, thereby gradually driving the raised section of the sheet metal to a flush condition relative to the surrounding surface of the sheet metal.

8. The sheet metal forming tool of claim 7, wherein said exposed outer surface of said hammer pad is generally convex.

9. The sheet metal forming tool of claim 7, wherein said exposed outer surface of said hammer pad is generally dome shaped.

10. The sheet metal forming tool of claim 7, wherein said inside surface of said hammer pad is concave and said distal end of said hammer is convex to nestle within said inside surface upon impact.

11. The sheet metal forming tool of claim 7, wherein said peripheral portion of said head is ring shaped.

* * * * *